US007375300B2

(12) United States Patent
Pedersen et al.

(10) Patent No.: US 7,375,300 B2
(45) Date of Patent: May 20, 2008

(54) SWITCH ASSEMBLY

(75) Inventors: Michael S. Pedersen, Des Plaines, IL (US); Brian Truesdale, Wauconda, IL (US)

(73) Assignee: Illinois Tool Works Inc., Glenview, IL (US)

( * ) Notice: Subject to any disclaimer, the term of this patent is extended or adjusted under 35 U.S.C. 154(b) by 153 days.

(21) Appl. No.: 11/452,500

(22) Filed: Jun. 14, 2006

(65) Prior Publication Data

US 2007/0051608 A1 Mar. 8, 2007

Related U.S. Application Data

(60) Provisional application No. 60/714,973, filed on Sep. 8, 2005.

(51) Int. Cl.
*H01H 3/12* (2006.01)

(52) U.S. Cl. ..... 200/341; 200/345

(58) Field of Classification Search ..... 200/520–530, 200/310–345, 61.45 M; 335/205–207
See application file for complete search history.

(56) References Cited

U.S. PATENT DOCUMENTS 3,557,332 A * 1/1971 Fernandes ..... 200/510
3,855,439 A 12/1974 Hermann
4,495,391 A 1/1985 Kitao et al.
4,514,601 A * 4/1985 Buchanan ..... 200/5 E
4,647,742 A 3/1987 Kitao et al.
4,950,856 A * 8/1990 Valenzona ..... 200/526
5,043,546 A * 8/1991 Krause ..... 200/527
5,049,709 A * 9/1991 Prickett et al. ..... 200/527
5,099,544 A * 3/1992 Yamamoto ..... 15/339
5,566,819 A * 10/1996 Lustgarten et al. ..... 200/407
5,679,936 A * 10/1997 Schaeffer et al. ..... 200/17 R
5,847,343 A * 12/1998 Kim ..... 200/61.76
6,437,270 B1 * 8/2002 Morrison et al. ..... 200/520
6,867,680 B1 * 3/2005 Kulle ..... 338/32 H
6,903,283 B2 * 6/2005 Skarlupka et al. ..... 200/16 B
6,965,085 B1 11/2005 Orrico et al.
6,972,385 B2 * 12/2005 Krebs et al. ..... 200/1 B
2005/0034966 A1 * 2/2005 Krebs et al. ..... 200/341
2005/0068135 A1 * 3/2005 Nishino et al. ..... 335/207

FOREIGN PATENT DOCUMENTS

DE 2512489 9/1976
EP 0523645 1/1993

* cited by examiner

*Primary Examiner*—Michael A Friedhofer
*Assistant Examiner*—Lisa N Klaus
(74) *Attorney, Agent, or Firm*—Mark W. Croll; Paul F. Donovan

(57) ABSTRACT

A switch assembly comprising a body, an actuator, and a base design to provide a device that can actuate various Hall-Effect chip devices in a single design. The switch assembly of the invention may provide a momentary switch connection, such as a single push system, or a maintained switch connection, such as a push-push system. Further, the switch assembly may include feedback mechanisms, such as LED components and the like that provide a visible feedback of the switch connection, and tactile feedback components that also indicate the switch connection.

16 Claims, 6 Drawing Sheets

SWITCH ASSEMBLY

CROSS REFERENCE TO RELATED APPLICATIONS

This Non-Provisional Application claims benefit to U.S. Provisional Application Ser. No. 60/714,973 filed Sep. 8, 2005.

FIELD OF THE INVENTION

The present invention relates generally to switches and, more particularly, to push-button switches that can be used with various controls, equipment, and other applications.

BACKGROUND OF THE INVENTION

Push-button switches are known. Push-button switches are used in various applications such as industrial equipment control handles, outdoor controls, and medical equipment, to name a few. Typically, push-button switches are used to either close or open an electrical circuit depending on the application. For example, with one known type of push-button switch, when the button is pressed, the circuit will close and will stay closed while the button is pressed. Upon the release of the button, the circuit will open. To close the circuit again, the button will need to be re-pressed. These types of switches provide a momentary on/off operation as the button is pressed and released.

A known version of the momentary push-button switch uses a mechanical switch assembly that includes a conductive member, such as a conductive bar, that is coupled to the button. In use, when the button is pressed, the bar is caused to come into contact with a pair of spaced-apart electrical switch terminals mounted to the switch body. Once in contact, the circuit between the switch terminals closes and will remain closed as long as the button remains pressed. Upon the release of the button, the conductive bar will move away from the terminals, thereby opening the circuit. While it is common for this type of momentary switch to close the circuit when the button is pressed, it is also known to provide a momentary push-button switch that opens the circuit between the terminals when the button is pressed. Moreover, although momentary switches described above are common, it is also known to provide a push-button switch that maintains a connection with one action and then changes the connection with another action (e.g., push-push action). With this maintained connection switch, pressing and releasing the button closes the circuit between the terminals, and pressing and releasing the button a second time opens the circuit. Similarly, the maintained connection switch may be configured to open the circuit upon pressing and releasing the button, while pressing and releasing the button a second time closes the circuit.

In another known version of the push-button switch, rather than a mechanical switch operation, a Hall-Effect, integrated circuit is used. In the Hall-Effect version, the conductive bar of the mechanical version is replaced with a magnet. The magnet is located within a plunger that is positioned within the switch body. The plunger is operatively connected to the button. The magnet cooperates with a Hall-Effect chip that is also positioned within the switch body and is electrically connected to the switch terminals. As known in the art, the Hall-Effect magnet and chip functionally provide the on/off operation of the switch.

Still another known version of the push-button switch includes the use of a light-emitting diode (LED). The LED is typically not associated with the switching operation, rather is provided as a desired indicator means. In other words, the LED will sense or detect when the switch is open or closed and will transmit a light signal to indicate such condition.

Typically, push-button switches are attached to a matching component or surface by way of a snap mount, thread mount, or surface mount.

The known push-button Hall-Effect switches, however, have certain drawbacks. As described above, a Hall-Effect switch requires a magnet and a Hall-Effect chip positioned within the switch body. Additionally, switch assemblies including an LED, generally used as an indicator, include the LED positioned within the switch body. These switch designs have varying uses and applications. Because of the various switch designs and applications, multiple parts and components are required resulting in significant costs and assembly time. It is therefore desirable to provide a simplified, inexpensive universal Hall-Effect switch assembly configured and adapted to actuate a surface mount Hall-Effect chip device and LED, if an LED is provided. The present invention is directed at providing such a switch assembly.

SUMMARY OF THE INVENTION

The present invention is directed to a switch assembly that can actuate any of the various Hall-Effect chip devices as chosen by the user of the switch assembly. The switch assembly may provide a momentary switch connection, such as a single push system, or a maintained switch connection, such as a push-push system. Moreover, the present invention may include feedback mechanisms, such as LED components and like sensors to provide a visible feedback of the switch connection, and may include tactile feedback components that provide a tactile feedback of the switch connection.

Other features and advantages of the invention will become apparent to those skilled in the art upon review of the following detailed description, claims and drawings in which like numerals are used to designate like features.

Figure 1:
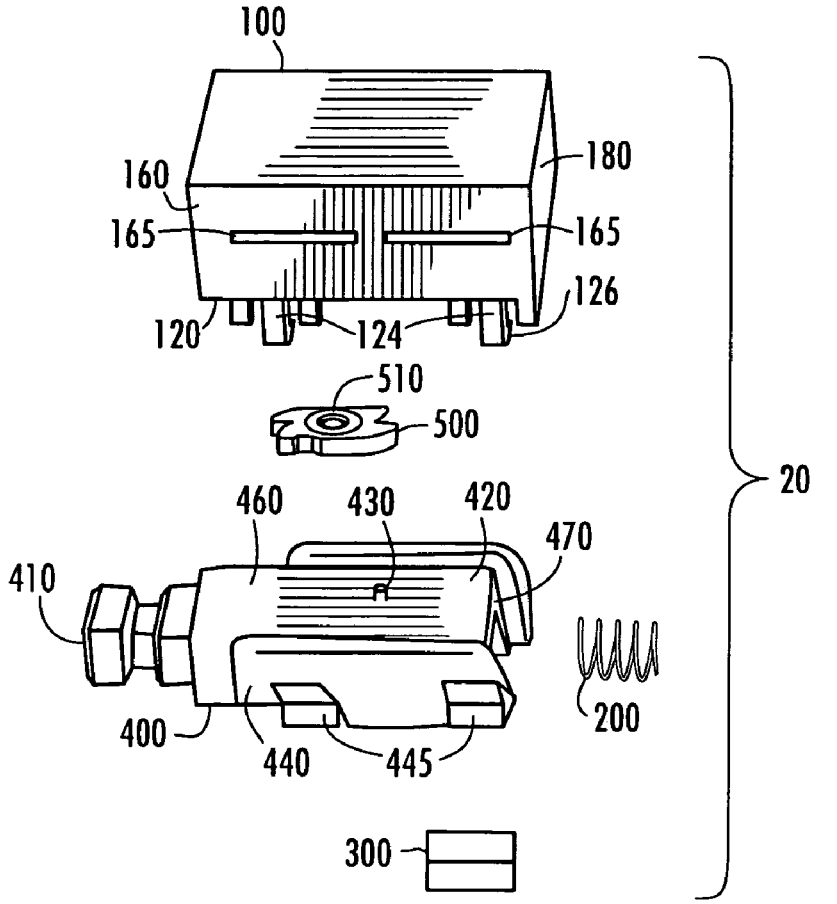
FIG. 1 is an exploded isometric view of the switch assembly of the present invention.
Figure 1:
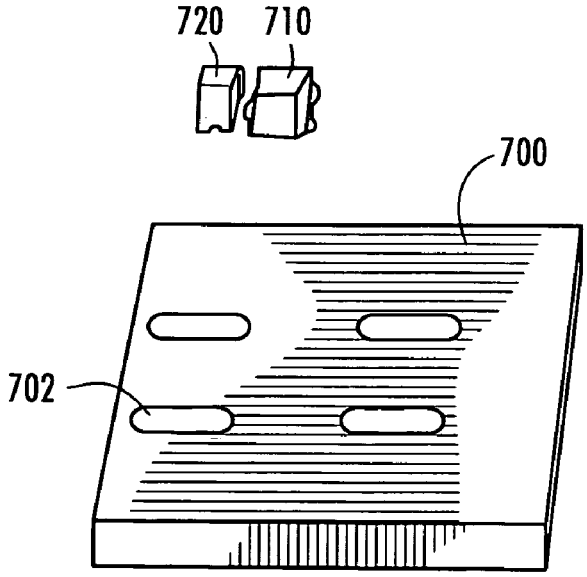

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE EMBODIMENTS

Referring to the figures there is depicted a switch system of the present invention. The switch system may be used with numerous electronic products, such as computers, business machines, music keyboard mixers, and the like. The switch system may provide a momentary switch connection, such as a single push system, or a maintained switch connection, such as a push-push system, also as described below. In addition, the switch system may work with a Hall-Effect chip device, an LED and accompanying components, along with tactile feedback features and other switch options. With the present invention, a single switch system can therefore accommodate all of the foregoing parts and components to provide numerous desirable switch features and options, thereby making the switch system applicable for numerous desired applications. One skilled in the art will understand and appreciate the numerous other possible uses and applications for the switch system.

Referring to FIG. 1, in an exemplary embodiment, the switch system includes a mounting surface or device, such as a printed circuit board ("PCB") 700 and a switch assembly 20. The switch assembly includes generally a body 100, a spring 200, a magnet or magnets 300, and an actuator or plunger 400 (actuator and plunger are used herein interchangeably). The switch assembly 20 may optionally include a pawl 500. The body 100 is configured to contain the numerous internal components of the switch assembly 20, as discussed below.

Figure 5:
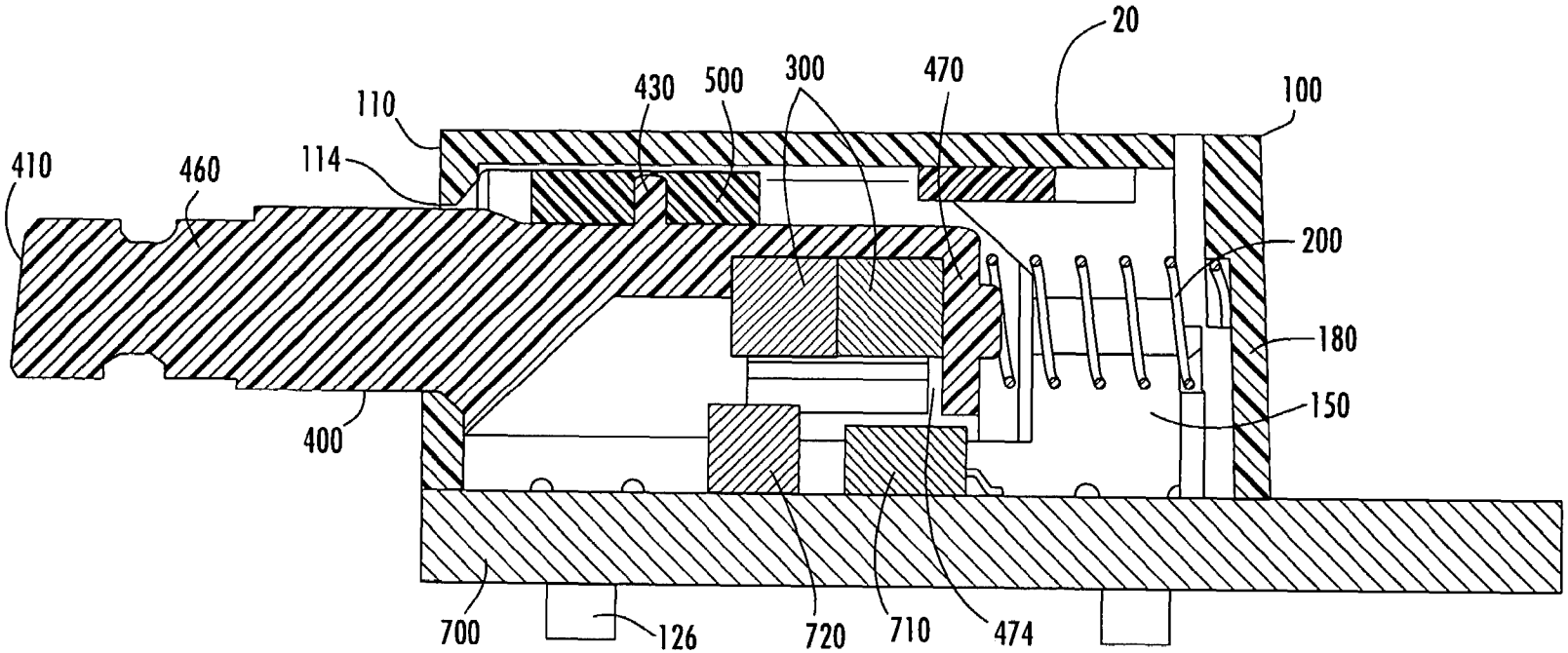
FIG. 5 is a side elevation cross-section view of the switch assembly of FIG. 4 taken at line 5-5.

As illustrated in FIG. 5, the body 100 also defines a first end 110 with a first opening 114 from which extends a first end 410 of the plunger 400. In some embodiments, also attached to the first end 410 of the plunger 400 is a key cap or button, not shown (key cap and button are used herein interchangeably), which snap-fits over the first end 410 of the plunger 400. The switch assembly 20 is adapted to be used with any of a variety of Hall-Effect chip devices and/or LEDs, including components available off-the-shelf, allowing the end-user to select a Hall-Effect chip device and/or LED of their choosing that may be suitable for their needs, such as lower power consumption and lower noise switching technology.

Referring to FIGS. 1-6, the body 100 is generally rectangular box shaped, though other body configurations are possible. A base 120 serves to secure the switch assembly 20 to an associated mounting surface 700. Extending outwardly from the base 120 are flexible flanges or fingers 124 that serve to snap-fit the switch assembly 20 to mating openings 702 in the associated device or mounting surface 700, thereby securing the switch assembly 20 to the associated device or mounting surface. The flanges 124 further define flange ends 126 that include ridges to assist in securing the switch assembly 20 to the associated device or mounting surface by providing a gripping surface that extends through openings 702 and engages the surface of the associated device or mounting surface 700. In other words, as the flexible flanges 124 are passed through a mating opening of the associated device or mounting surface, the flexible flanges 124 will flex inward and will flex back to their original position once the flanges 124 have fully passed through the opening. At this point, the flanges 124 engage the back wall of the mounting surface and prevent the switch assembly 20 from being pulled out of the opening. The ridges on the flange ends 126 will provide a gripping surface to further assist in preventing the switch assembly 20 from being removed from the mating opening. In an alternative configuration, the body 100 may be mounted directly to the associated device or mounting surface with other fasteners, adhesives or through other well-known mechanical and chemical methods.

Figure 4:
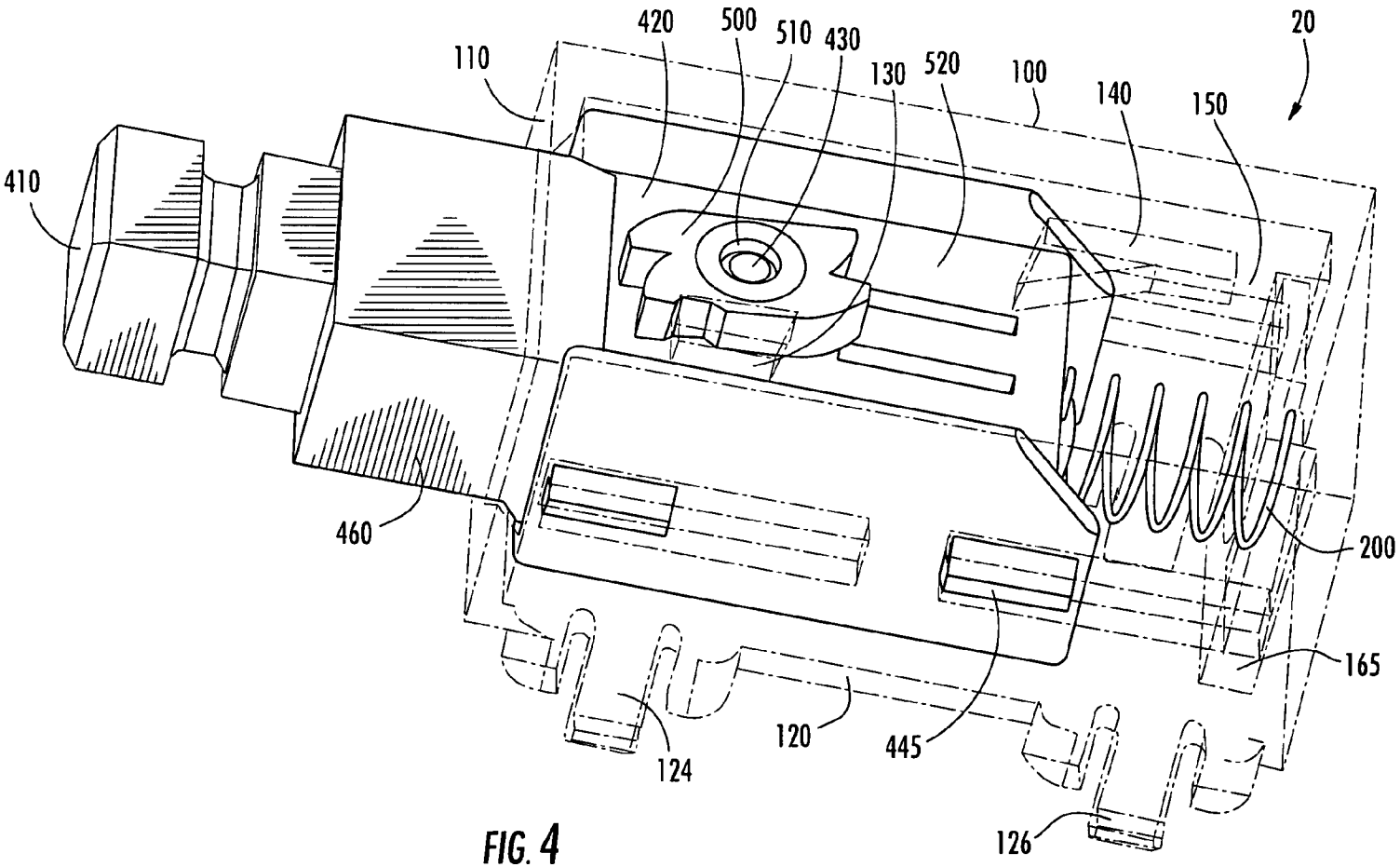
FIG. 4 is an isometric view of the switch assembly illustrating the pawl of the present invention.

As illustrated in FIG. 1, the plunger 400 defines a wall member 420. The wall member 420 extends longitudinally within the body 100. The plunger 400 further defines a projecting member or knob 430 (projecting member and knob are used herein interchangeably) that extends from the wall member 420 and serves to position and hold a pawl 500 by engaging a hole 510 in the pawl 500. As shown in FIG. 4, the pawl 500 is permitted to rotate about the projecting member 430 as the projecting member 430 is moved with the plunger 400 and the pawl 500 moves in a pawl slot or track 520. If a maintained connection for the switch system is desired, that is, a push-push operation, the pawl 500 is used to enable this push-push operation of the system and to provide the maintained connection.

Figure 6:
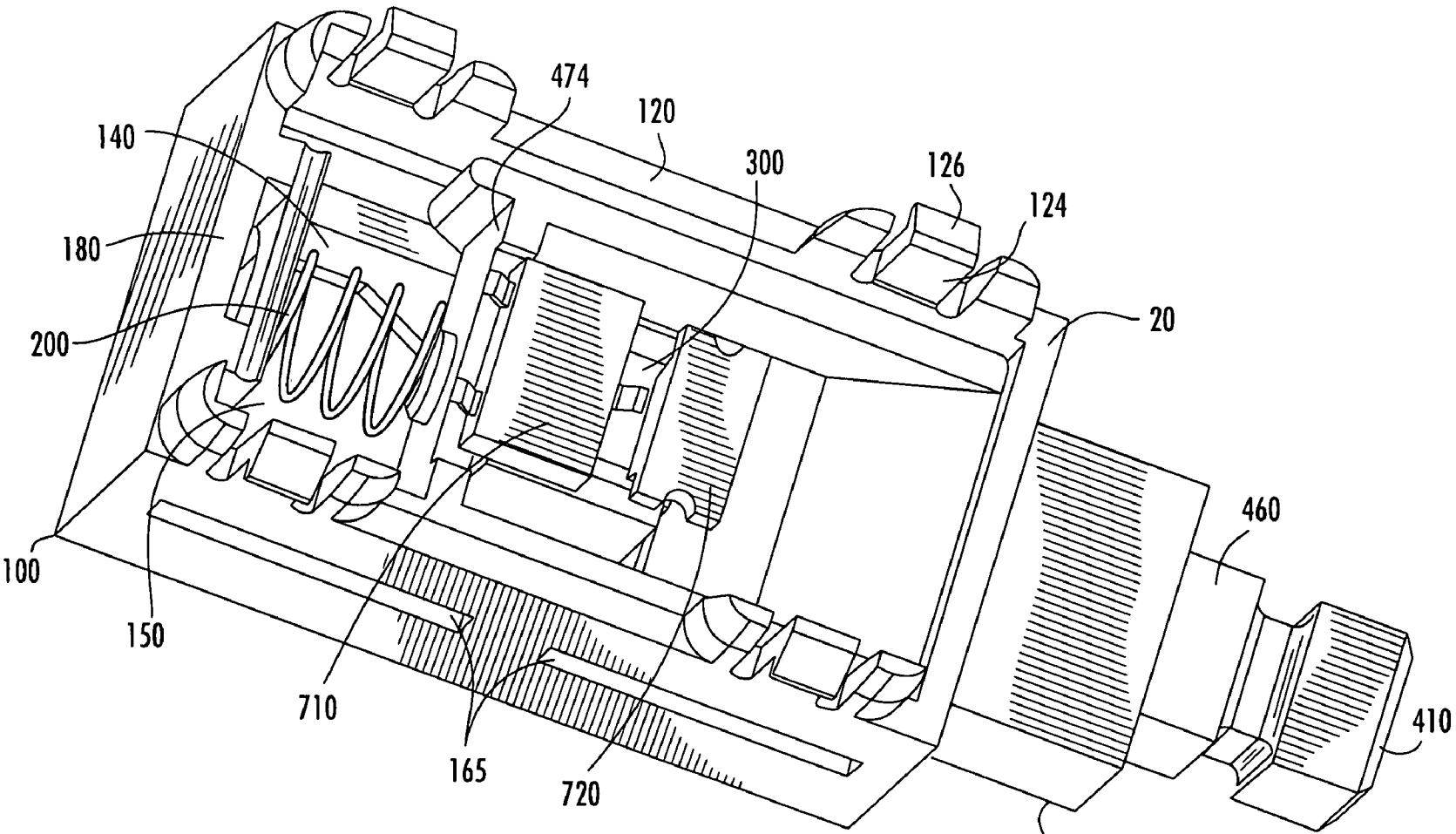
FIG. 6 is an isometric view of the switch assembly of FIG. 1 as seen from the bottom.

As illustrated by FIGS. 4 and 6, the body 100 includes protrusions 130 and 140 in the pawl track 520 that force the pawl 500 to rotate about the projecting member 430 of the plunger 400 as the plunger 400 moves within the body 100 and assists in providing the push-push operation. As discussed below, the projecting member 430, which is operatively connected to the plunger 400, in conjunction with the protrusions 130 and 140 of the body 100 will force the pawl 500 to rotate and engage with the protrusions 130 and 140 of the body 100 in the track 520 as the plunger 400 is pressed.

For a momentary connection, or single push operation, the pawl 500 is not used and the projecting member 430 will simply extend through the track 520. When the plunger 400 is pressed, the projecting member 430 will move within the track 520.

Referring to FIGS. 1-5, a plunger 400 is positioned within an inner rectangular box portion 150 of the body 100. The plunger 400 may be attached to the body via a snap-fit arrangement between the plunger 400 and the body 100. The body 100 defines openings 165 along side 160 of the body 100 and openings positioned opposite the openings 165 on the opposite side (not shown) of the body 100. Protrusions 445 on the plunger 400 will fit through the openings 165. The plunger 400 and body 100 are configured such that the plunger 400 may move within the body 100 and will move within the body 100 upon a user pressing the first end 410 of the plunger 400 attached to the first end 410 of the plunger 400. The plunger 400 further defines a rectangular box body 460 and a second end 470. The second end 470 further defines a hollow interior 474 formed in the plunger rectangular box body 460. The hollow interior 474 of the plunger 400 is adapted to contain switch components such as a Hall-Effect magnet 300.

Referring to FIGS. 1, 5 and 6, in an exemplary embodiment, a magnet 300 is positioned within the hollow interior 474 of the plunger 400. The magnet 300 is generally configured to match the shape of the hollow interior 474 of the plunger and may be press-fit, or secured through other techniques, to the hollow interior 474. As known in the art, the magnet 300 will cooperate with a Hall-Effect chip device 710 that is surface mounted to the associated device or mounting surface 700. The Hall-Effect chip device 710 can be any of various Hall-Effect chip devices selected by the user of the switch assembly.

A spring 200 may be attached between the second end 470 of the plunger 400 and a fourth end 180 of the body 100, opposite the first end 110 of the body 100. The spring 200 may be captured between the body 100 and the plunger 400 and may provide return motion of the plunger 400 when depressed.

The plunger 400 may be made of a clear plastic or similar transparent material so as to function as a light pipe in those assemblies and configurations that utilize an LED or similar position indicators. That is, the light transmitted from the LED or other indicators will transmit through the clear plunger 400 and will illuminate through the first end 410 of the plunger 400 or an opening 610 in the optional key cap. It should be understood that the plunger 400 can be clear or transparent, or can be any other desirable color.

Figure 2:
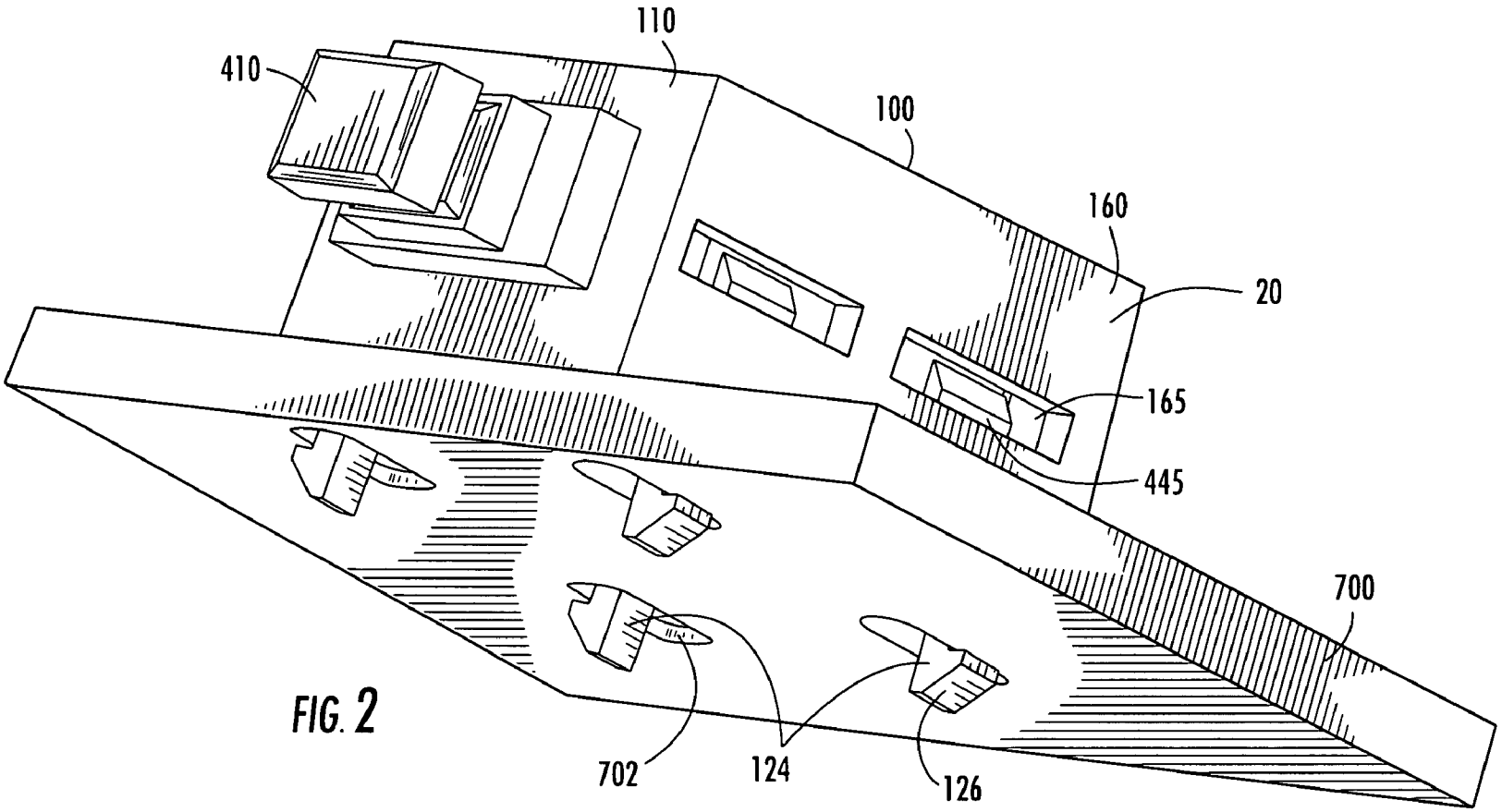
FIG. 2 is an isometric view of the switch assembly of the present invention with the plunger in the "on" position.
Figure 3:
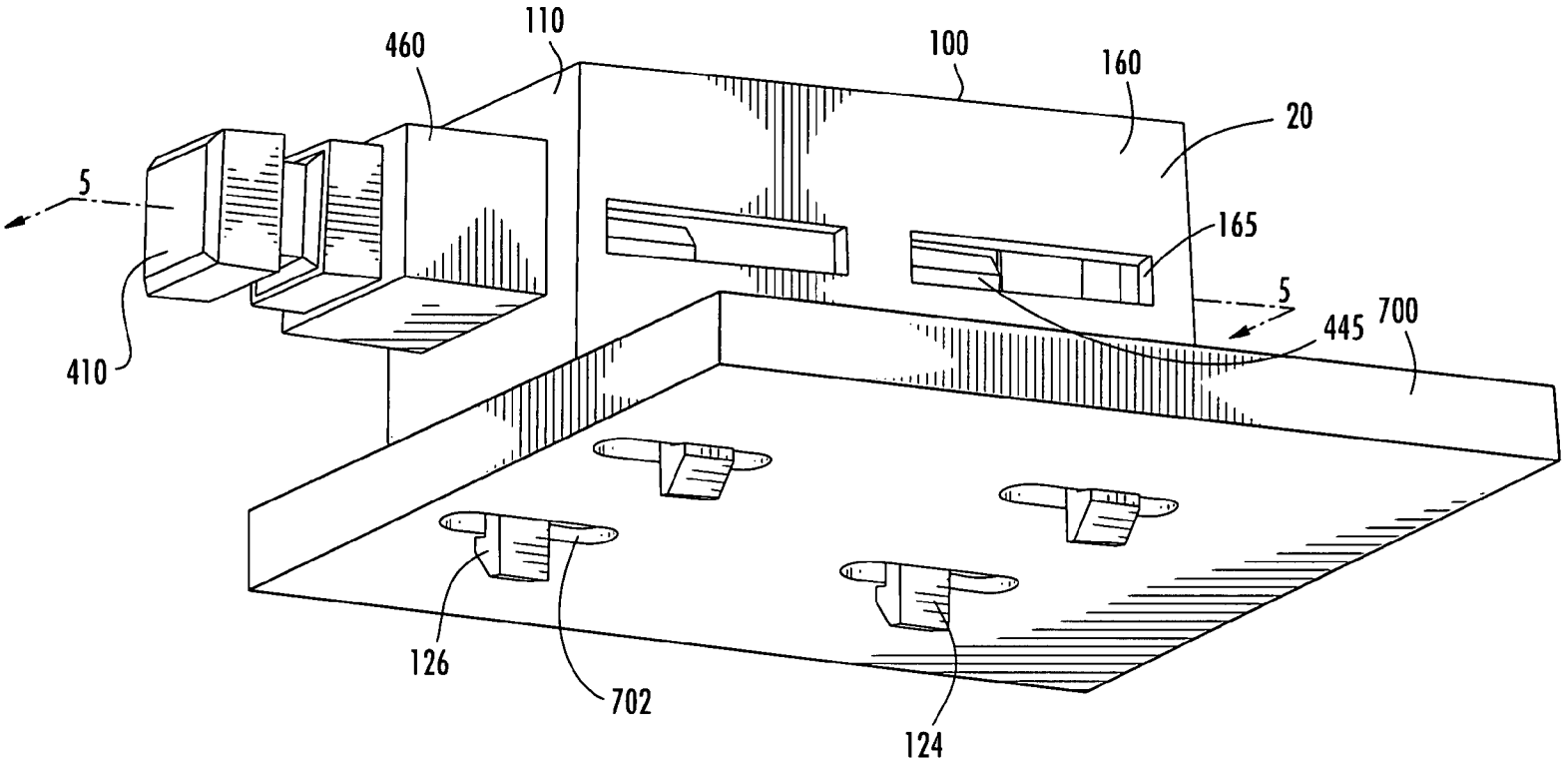
FIG. 3 is another isometric view of the switch assembly of the present invention with the plunger in the "off" position.

As illustrated in FIGS. 1, 4 and 5, the plunger 400 is also adapted to include the projecting member 430 extending outwardly from the exterior surface of the plunger 400 to cooperate with a push-push assembly for a maintained connection. That is, the projecting member 430 extends outwardly from the wall of plunger 400, through the track 520 in the wall 420 of the plunger 400, and into engagement with the pawl track 520. In use, as the plunger 400 is pressed, the projecting member 430 will engage and force the pawl 500 along the pawl track 520 in the same direction of movement as the plunger 400. The movement of the pawl 500 in the pawl track 520 in cooperation with the protrusions 130 and 140 from the body 100 will force the pawl 500 to rotate about the projecting member 430 of the plunger 400 and, when the plunger 400 is released, the pawl will catch on the protrusion 130 to achieve the push-push operation of the system, resulting in the plunger 400 being in a retained position as shown in FIG. 2. When the plunger 400 is pushed again, the protrusion 140 will cause the pawl 500 to rotate such that when the plunger 400 is released, the spring 200 will force the plunger 400 back to its original position as shown in FIG. 3. Significantly, with the present invention, a single switch system design can accommodate all of the foregoing options.

Referring to FIG. 5, the Hall-Effect chip device 710 is positioned on the surface of the associated device or mounting surface 700. To complete the Hall-Effect, as stated above, centrally positioned within the plunger 400 is the Hall-Effect magnet 300. Again, the magnet 300 cooperates with the Hall-Effect chip device 710 to provide the on/off operation of a switch, as known in the art.

Referring to FIGS. 1, 5 and 6, if an LED is desired for use with the switch system, an LED 720 may be surface mounted to the associated device or mounting surface 700. The LED 720 may be any known LED suitable for mounting to a push-button switch. In use, the LED assembly will function as an indicator of the operation of the switch system upon the user pressing the plunger 400. As stated above, the light emitted from the LED 720 will transmit through the plunger 400 and will be seen through the first end 410 of the plunger. In an alternative embodiment, the switch assembly 20 may be configured to provide a tactile feedback, as known in the art, when the plunger 400 is pressed.

Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A switch system comprising:
a switch assembly comprising:
a body defining a hollow interior and a first end, the first end defining an opening,
a magnet,
a spring, and
a plunger extending into the hollow interior of the body, the plunger defining a hollow interior and a projecting member extending outwardly from a first wall of the plunger, the hollow interior of the plunger adapted to receive the magnet, and
a mounting surface including a hall-effect chip device,
wherein the switch assembly is adapted to attach to the mounting surface and operate with the hall-effect chip device mounted to the mounting surface, and
wherein the body further defines flexible flanges adapted to mount the switch assembly to the mounting surface.

2. The switch system as set forth in claim 1, wherein the switch assembly further comprises a push-push mechanism.

3. The switch system as set forth in claim 1, wherein the mounting surface is a printed circuit board.

4. The switch system as set forth in claim 1, wherein the switch assembly is attached to the mounting surface by an adhesive.

5. The switch system as set forth in claim 1, wherein the plunger is transparent.

6. The switch system as set forth in claim 5, wherein the transparent plunger is adapted to transmit light from an LED mounted on the mounting surface.

7. A switch system comprising:
a switch assembly comprising:
a body defining a hollow interior and a first end, the first end defining an opening,
a magnet,
a spring, and
a plunger extending into the hollow interior of the body, the plunger defining a hollow interior and a protecting member extending outwardly from a first wall of the plunger, the hollow interior of the plunger adapted to receive the magnet, and
a mounting surface including a hall-effect chip device,
wherein the switch assembly is adapted to attach to the mounting surface and operate with the hall-effect chip device mounted to the mounting surface,
wherein the switch assembly further comprises a pawl between a first wall of the plunger and a top of the body.

8. The switch system set forth in claim 7, wherein the plunger further defines a projecting member extending outwardly from the first wall of the plunger.

9. The switch system as set forth in claim 7, wherein the body and the plunger further define a pawl track, and wherein the projecting member of the plunger operatively engages an opening in the pawl.

10. A switch system comprising:
a switch assembly comprising:
a body defining a first end, a second end, a top, a bottom, and a hollow interior,
a transparent plunger extending into the hollow interior of the body, the plunger defining a hollow interior and a projecting member extending outwardly from the plunger, a spring positioned between the second end of the body and a first end of the plunger, a hall-effect magnet positioned within the hollow interior of the plunger, and a pawl mounted between a first wall of the plunger and the top of the body, the first wall of the plunger and the top of the body defining a pawl track, wherein the projecting member of the plunger extends through an opening in the pawl, engaging the pawl, and a mounting surface including a hall-effect chip device, wherein the switch assembly is adapted and configured to attach to the mounting surface and operate with the hall-effect chip device mounted to the mounting surface.

11. The switch system as set forth in claim 10, wherein the bottom of the body further comprises flexible flanges adapted to mount the switch assembly to the mounting surface.

12. The switch system as set forth in claim 11, wherein the switch assembly further comprises a push-push mechanism.

13. The switch system as set forth in claim 11, wherein an LED is mounted to the mounting surface.

14. The switch system as set forth in claim 13, wherein the transparent plunger is adapted to transmit light from the LED mounted on the mounting surface.

15. The switch system as set forth in claim 11, wherein the mounting surface is a printed circuit board.

16. The switch system as set forth in claim 10, wherein the mounting surface is a printed circuit board.

* * * * *